US006152440A

United States Patent [19]

Yip et al.

[11] Patent Number: 6,152,440

[45] Date of Patent: Nov. 28, 2000

[54] SHEET MEDIA HANDLING SYSTEM

[75] Inventors: Kok Sam Yip; Pui Wen Huang; Choon Siang Peck, all of Singapore, Singapore

[73] Assignee: Hewlett-Packard Company, Palo Alto, Calif.

[21] Appl. No.: 09/452,842

[22] Filed: Dec. 3, 1999

[51] Int. Cl.[7] ..... B65H 3/44

[52] U.S. Cl. ..... 271/9.11; 271/9.13; 271/171

[58] Field of Search ..... 271/9.11, 9.13, 271/160, 171, 9.01

[56] References Cited

U.S. PATENT DOCUMENTS

| | | | |
|---|---|---|---|
| 3,323,790 | 6/1967 | Pankow | 271/9.11 X |
| 5,222,722 | 6/1993 | Kamano | 271/171 X |
| 5,287,164 | 2/1994 | Watanabe | 271/9.11 X |
| 5,346,197 | 9/1994 | Takano et al. | 271/171 X |

*Primary Examiner*—David H. Bollinger

[57] ABSTRACT

A sheet media handling system for aligned feeding of sheet media of different widths is disclosed. This sheet media handling system caters to a wide-format printer which has two media trays, a main tray and a bypass tray positioned above the main tray. In such a printer, a larger width sheet medium in the bypass tray is insufficiently supported when a stack of smaller width sheet media is present in the main tray. Such a situation may result in skewing or jamming of the larger width sheet medium. The sheet media handling system overcomes such a problem by having a secondary pressure plate in addition to a primary pressure plate. This secondary pressure plate is moveable independently of the primary pressure plate so that the secondary pressure plate is operable to provide appropriate support for the partially supported larger width sheet medium in the bypass tray.

11 Claims, 7 Drawing Sheets

SHEET MEDIA HANDLING SYSTEM

FIELD OF THE INVENTION

This invention relates to a sheet media handling system for supporting both small and large width sheet media. More particularly, this invention relates to a sheet media handling system having a bypass tray positioned above a main tray for aligned feeding of small and large width sheet media to a single infeed zone of a printer from either trays.

BACKGROUND

Office equipment such as photocopiers, laser printers, ink jet printers and other imprinting mechanisms today incorporate an ability to receive sheet media from any one of two or more trays. It is very common to have a bypass tray in which a single sheet medium of a special type or of a different size can be conveniently fed for particular printing without having to load it onto pull-out trays. Such a bypass tray is useful for tasks such as printing a formal document on a sheet medium with a pre-printed company letterhead, printing on a single sheet of transparency and printing a final copy of a document on a better quality sheet medium. In these circumstances, it will be convenient for a user to simply load the appropriate sheet medium to be printed on an exposed bypass tray. Such bypass trays are commonly found in small-format printers, for example the ink jet printers for printing on smaller width (A4 and Letter size) sheet media. These printers are popular amongst home and general office users. However, with advancement in speed and resolution of such printers, these ink jet printers have now become appealing to a different segment of users which requires printing on larger width sheet media, such as B4 size paper.

One prior art media handling system has a pressure plate pivotably mounted on a base of a printer. During a pick cycle, the pressure plate is lifted to move a stack of sheet media located above it to an infeed zone of the printer. This pressure plate is usually designed to directly support a stack of sheet media in a main tray. During each pick cycle, the sheet at the top of the stack will be moved to the infeed zone. A simple and economical design of a bypass feeding system usually has a bypass tray positioned above the main tray. Sheet media in this bypass tray is supported either by the pressure plate itself (when there is no sheet medium in the main tray) or by a stack of sheet media in the main tray. Such a design accords pick priority to any sheet medium in the bypass tray over that in the main tray. This design works well when the sheet media on both the bypass and main trays are of substantially the same width. When the media are of substantially the same widths, the sheet media in the main tray will be able to provide sufficient support for the sheet media in the bypass tray.

However, a serious problem results when the sheet medium in the bypass tray is substantially wider than a stack of sheet media in the main tray. For example, the sheet media in the bypass tray is of B4 size and the sheet media in the main tray is of A4 or Letter size. A substantially large portion of the B4 size sheet medium in the bypass tray will not be supported by the A4 or Letter size sheet media in the main tray. The problem is not so serious when there is only a small stack of sheet media in the main tray. A small stack will create only a small height differential between portions of the B4 size sheet medium. In such a case, the B4 size sheet medium is still fairly well supported, partly by the stack of sheet media in the main tray and partly by the exposed portion of the pressure plate. As a result, the B4 size sheet medium can be properly presented for picking by the pick mechanism in the printer. However, when the stack height of the smaller width sheet media in the main tray measures half an inch or more, a relatively large portion of the B4 size sheet medium would not be supported by the pressure plate and would sag at the arris of the stack of sheet media in the main tray. Such sagging is detrimental to the aligned feeding of the B4 size sheet medium into the printer as the sheet medium will not be properly presented to the pick mechanism. The pick mechanism is only able to properly engage the portion of the B4 size sheet medium that is supported by the stack of sheet media in the main tray. As a result, the properly engaged portion will be drawn into the printer ahead of the rest of the sheet medium. Such an action would cause the sheet medium to follow an oblique course or a deviation from a predetermined straight line path when being received into the printer. Such unbalanced drawing of the B4 size sheet medium results in skewing of the sheet medium. This skewing causes undesirable result, for text printed on the skewed sheet medium will appear misaligned, crooked or oblique. In some cases, when the skew is severe, the sheet medium may end up jammed in the printer.

To prevent the unbalanced support or sagging of the B4 size sheet medium, a user can remove the stack of smaller width sheet media from the main tray before printing on the B4 size sheet medium. The removal of the sheet media in the main tray will result in the B4 size sheet medium being fully supported by the pressure plate. However, such extraneous removal of the sheet media from the main tray defeats the purpose of having a bypass tray. It is cumbersome and unacceptable from the point of usability for a user to have to empty and replenish the main tray each time a larger width sheet medium is to be printed.

From the foregoing, the prior art therefore has a need for an improved sheet media handling system which is able to provide aligned feeding of a larger width sheet medium when placed over a stack of smaller width sheet media.

SUMMARY

In accordance with a preferred embodiment of the present invention, a sheet media handling system suitable for use in a printer includes a main media tray and a bypass media tray positioned above the main media tray. The system also includes a primary pressure plate for moving sheet media in the main tray and the bypass tray to an infeed zone of the printer. The system further includes a secondary pressure plate which is independently moveable of the primary pressure plate. When a stack of smaller width sheet media is placed in the main media tray, the secondary pressure plate is operable to provide appropriate support for a portion of the larger width sheet medium placed in the bypass tray which is otherwise partially supported by the stack of smaller width sheet media.

BRIEF DESCRIPTION OF DRAWINGS

The invention will be better understood with reference to the following drawings, in which.

DETAILED DESCRIPTION OF THE PREFERRED EMBODIMENT

Hereafter, a preferred embodiment of the present invention will be described in the context of an ink jet printer having a main media tray and a bypass tray. However, it is to be understood that the invention is usable with any imprinting or sheet handling equipment where a single pick mechanism is used to pick a sheet medium from one of a main and a bypass tray, the bypass tray being positioned above the main tray.

Figure 1:
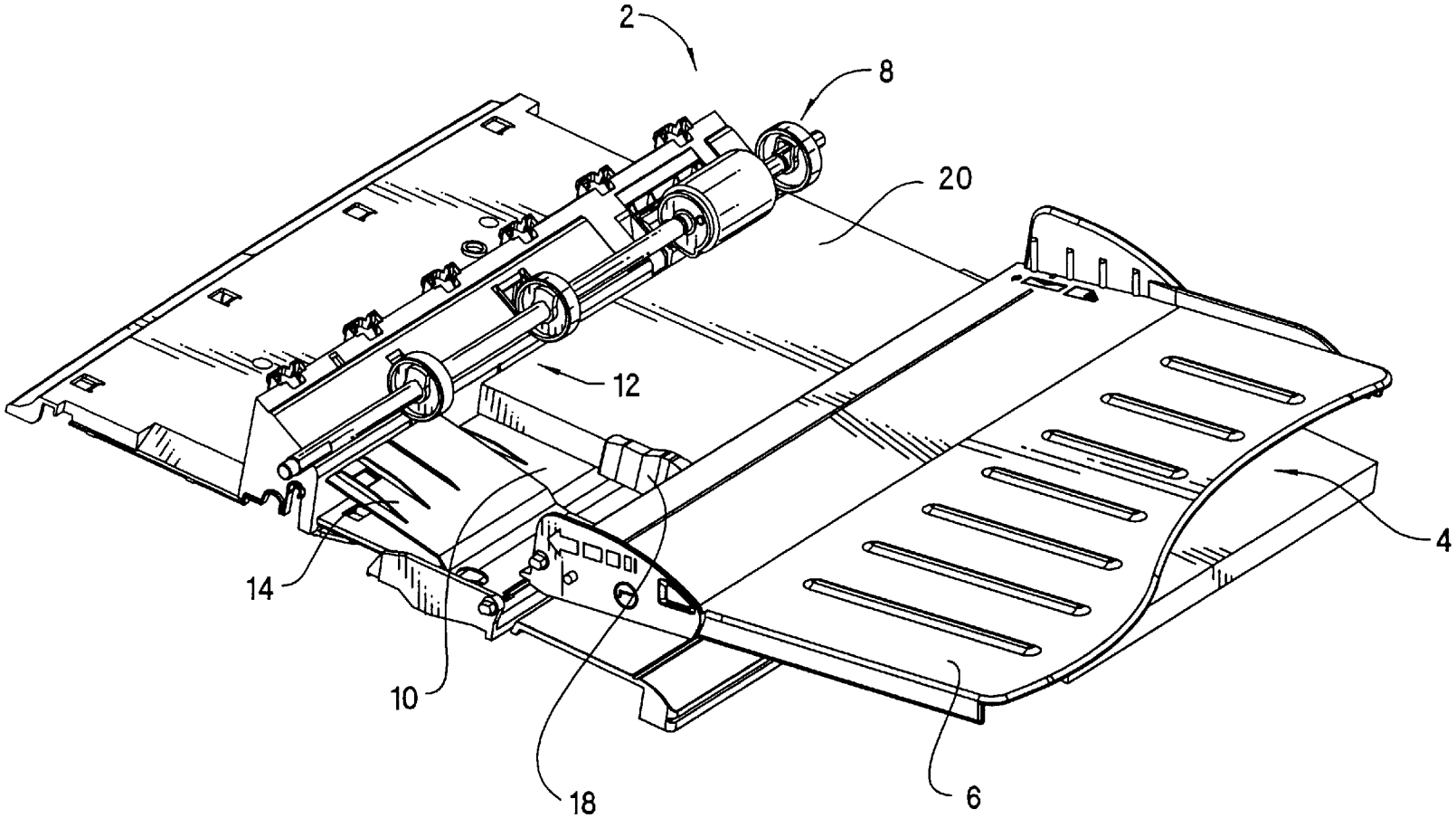
FIG. 1 is an isometric view of a portion of an ink jet printer having a sheet media handling system according to the present invention. The sheet media handling system has a main tray, a bypass tray, a primary pressure plate and a secondary pressure plate.

FIG. 1 is an isometric view of a portion of an ink jet printer 2 with a main tray (generally indicated as 4) and a bypass tray 6 located above the main tray 4. These trays 4, 6 are exposed in this preferred embodiment but may also be in the form of a pull-out tray. The printer also has a pick mechanism 8 and a primary pressure plate 10. The primary pressure plate 10 is biased by spring means (not shown) towards an infeed zone 12 of the printer 2. A cam (not shown) attached to the pick mechanism 8 holds this primary pressure plate in an unused position away from the infeed zone 12. During a pick cycle of the printer, the cam is rotated to allow the primary pressure plate 10 to move towards the infeed zone 12 of the printer 2 to present a sheet medium for picking by the pick mechanism 8. If sheet media are present in both the main and bypass tray 6, the topmost sheet medium in the bypass tray 6 will be picked. If there are only sheet media in the main tray, the topmost sheet medium in the main tray 4 will be picked.

After a sheet medium is drawn into the infeed zone 12 of the printer 2, the sheet medium is advanced into a print zone of the printer for printing. During the advancing of the sheet medium, the cam is rotated to push the primary pressure plate 10 away from the infeed zone 12 so that no new sheet medium can be drawn into the printer.

To solve the problem of not being able to properly support a large width sheet medium in the bypass tray 6, the media handling system further includes a secondary pressure plate 14. This secondary pressure plate 14 is pivotably mounted to the printer 2 and is independently moveable of the primary pressure plate 10. When in an unused position, the secondary pressure plate 14 sits in a correspondingly shaped indentation on an upper surface of the primary pressure plate 10 such that the top surface of the secondary pressure plate 14 is substantially flush with the rest of the surface of the primary pressure plate 10. Such a flush arrangement is important so that a sheet medium would be presented substantially flat to the pick mechanism 8 to prevent skew of the sheet medium. In this unused position, the secondary pressure plate 14 moves towards and away from the infeed zone 12 in accordance with the movement of the primary pressure plate 10.

Figure 2:
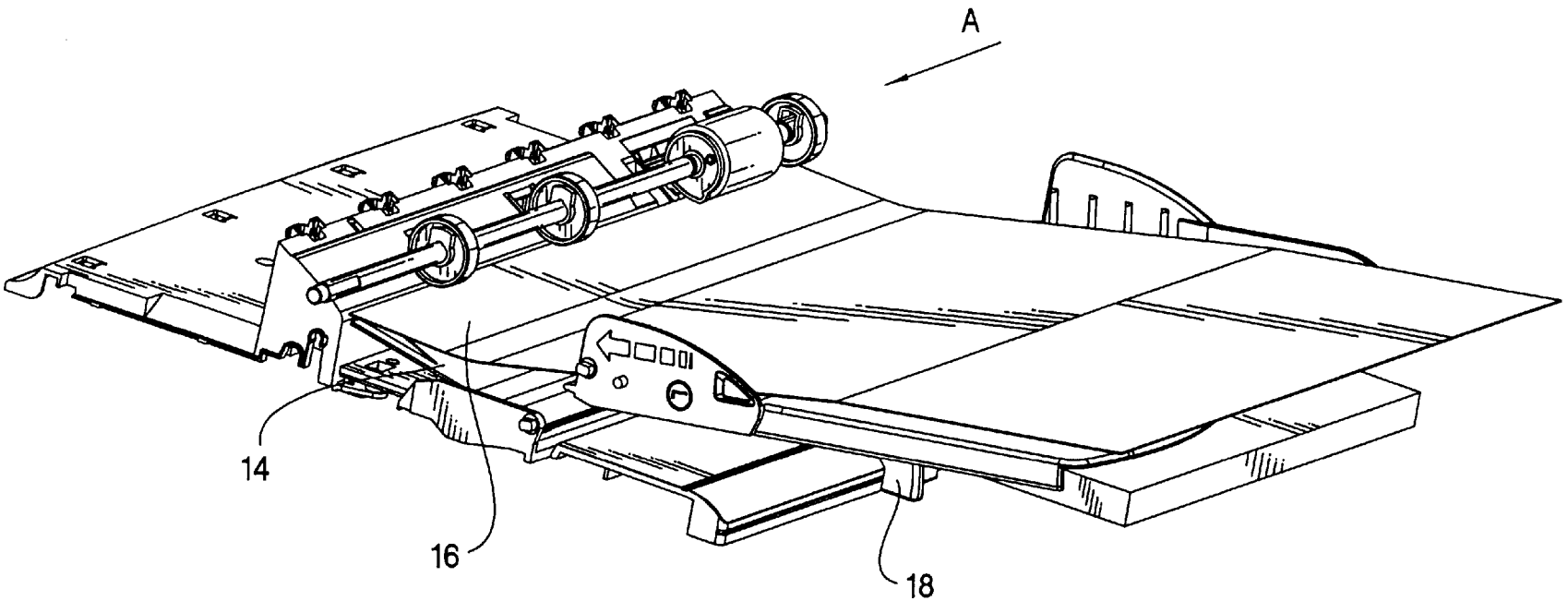
FIG. 2 is an isometric view of the portion of the ink jet printer in FIG. 1 showing the secondary pressure plate in an in-use position for supporting a larger width sheet medium in the bypass tray.

When in an in-use position, the secondary pressure plate 14 is moved independently of the primary pressure plate 10 to a position substantially close to the pick mechanism 8. FIG. 2 shows the secondary pressure plate in the in-use position for providing support for a portion of a B4 size sheet medium in the bypass tray 6. It is preferable that the secondary pressure plate 14 does not come into immediate contact with the pick mechanism 8 when in this position as any contact may cause unnecessary wear and produce unwanted noise. The secondary pressure plate 14 is required to be moved into this in-use position only when sheet media of a smaller width is placed in the main tray 4 so that a larger width sheet medium when placed on the bypass tray 6 can be sufficiently supported. For ease of use, a media guide 18 which is used to align a stack of sheet media in the main tray is preferably used to also actuate the secondary pressure plate 14. Using such a scheme of actuation, a user is spared the burden of having to remember to separately actuate the secondary pressure plate 14 to put it to use.

Figure 3:
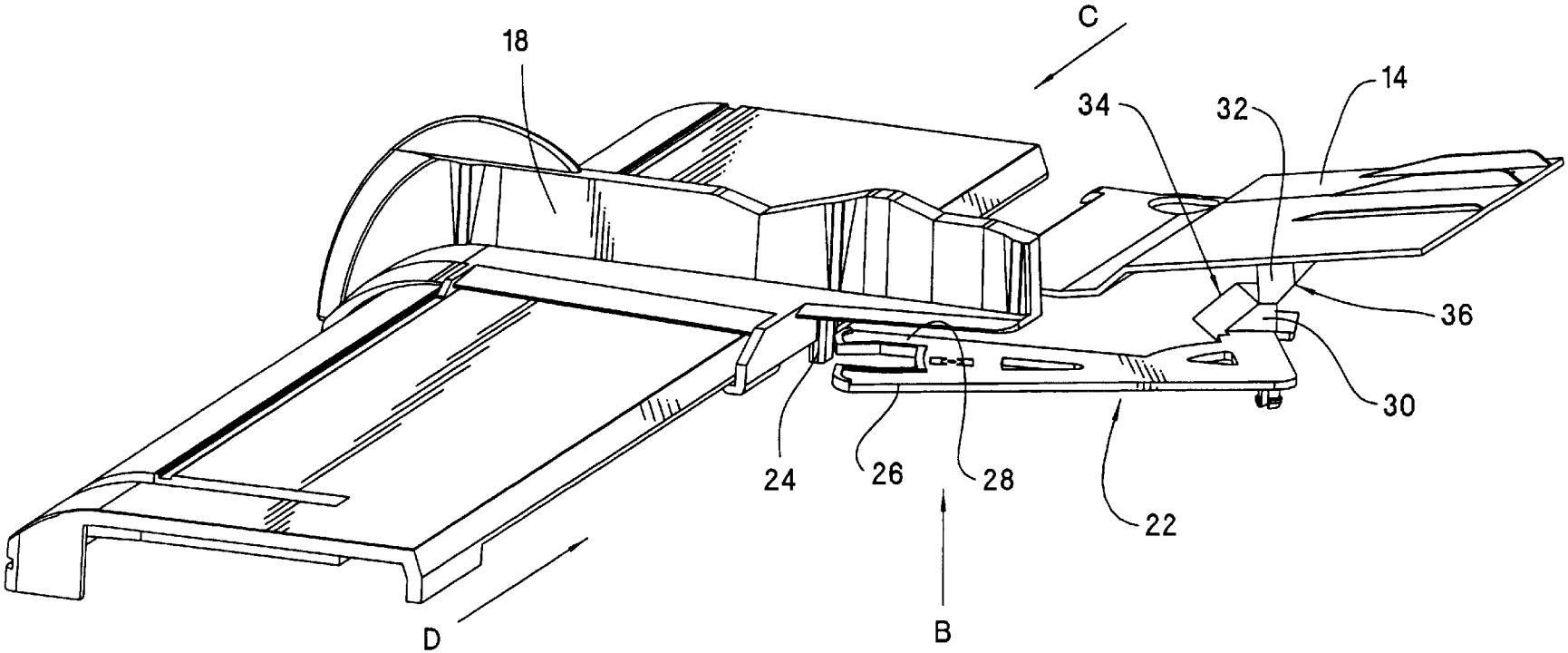
FIG. 3 is an isometric view seen in the direction of an arrow A in FIG. 2 showing a media guide which can be slid to align a stack of sheet media in the main tray. Also shown is a lifting plate which is actuable by the media guide for lifting and lowering of the secondary pressure plate.

FIG. 3 shows the media guide 18, the secondary pressure plate 14 and a lifting plate 22 which is actuable by the media guide 18 for lifting and lowering the secondary pressure plate 14. In the preferred embodiment, the media guide 18 is slidably mounted on the main tray 4. This media guide 18 when actuated by a user slides along the width of the main tray 4 for aligning a stack of sheet media on the main tray 4. The media guide 18 has an integral actuating pin 24. As the media guide 18 slides along its path, the actuating pin 24 actuates the lifting plate 22 for lifting the secondary pressure plate 14.

Figure 4:
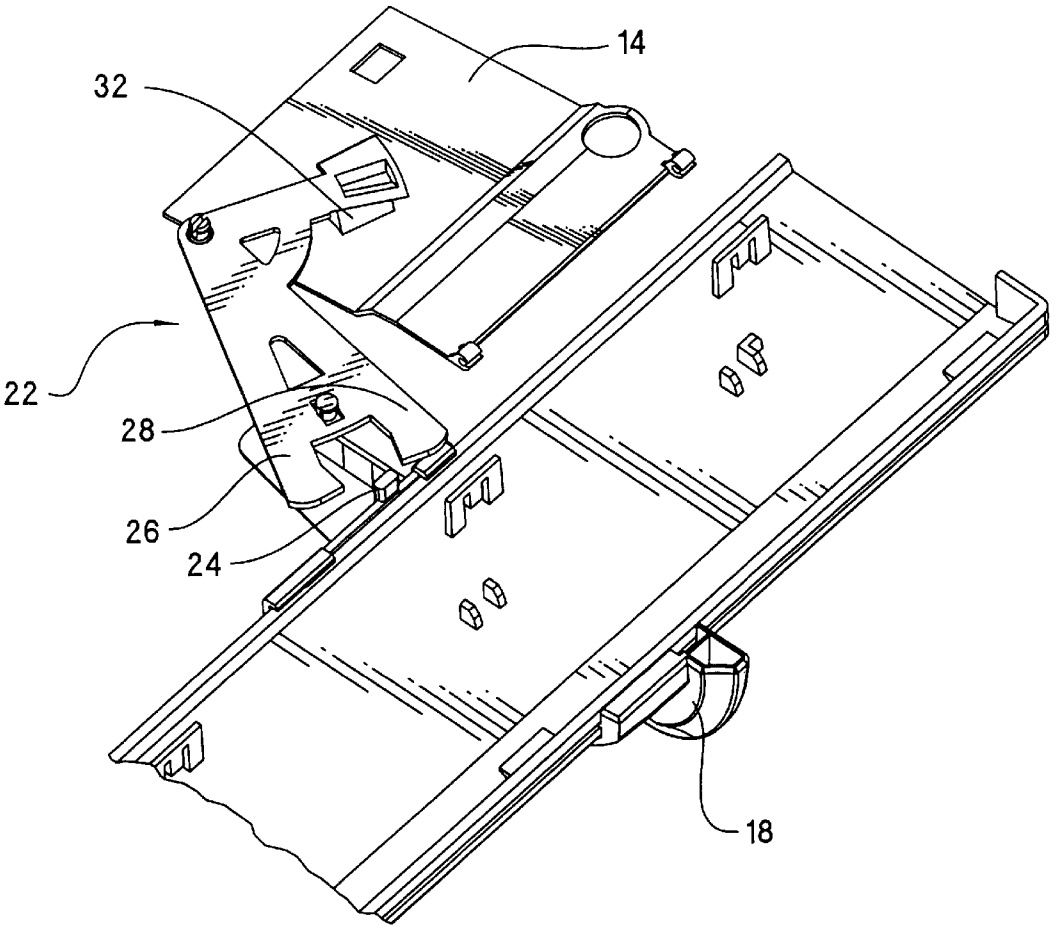
FIG. 4 is a bottom isometric view of the media guide and lifting plate in FIG. 3 as seen in a direction according to an arrow B in FIG. 3.
Figure 5:
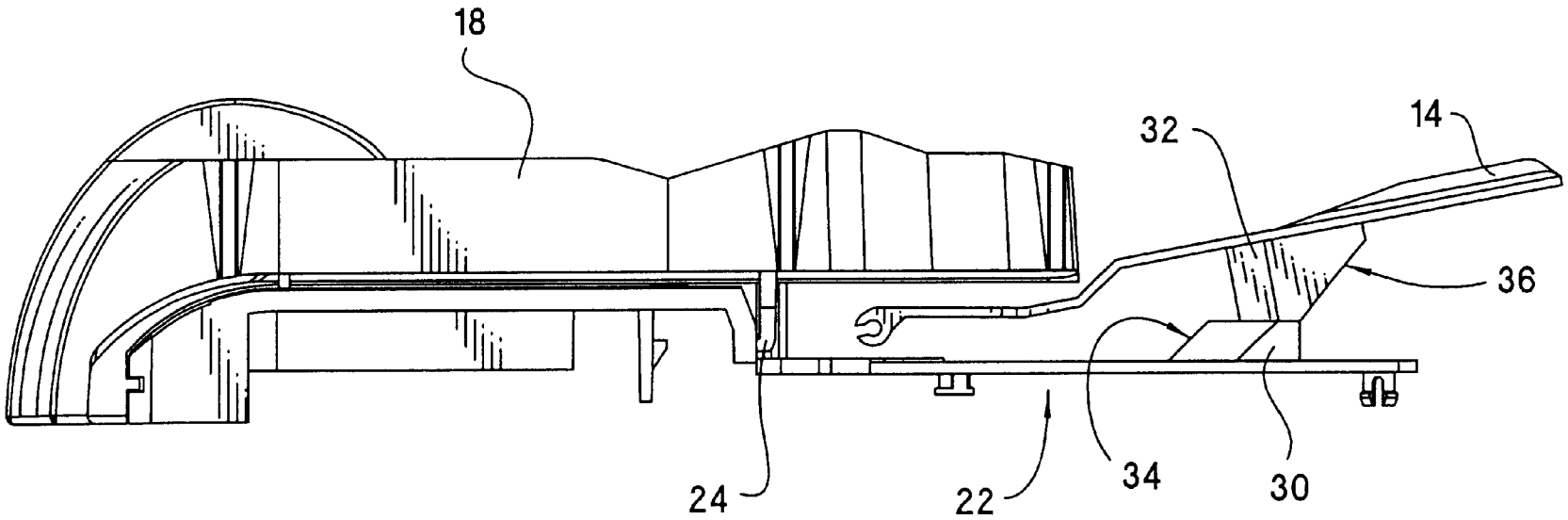
FIG. 5 is a side elevation of the media guide, lifting plate and secondary pressure plate as seen in a direction according to an arrow C in FIG. 3. The secondary pressure plate is shown in an in-use position.

FIG. 4 shows a bottom view of the media guide 18, the secondary pressure plate 14 and the lifting plate 22. The lifting plate 22 is pivotably mounted to the base of the printer 2. The lifting plate has two arms, a lifting arm 26 and a lowering arm 28, integrally connected to each other. Connected to these arms is an integral ramp 30. When the media guide 18 slides in a direction to align a stack of smaller width sheet media in the main tray 4, the actuating pin 24 on the media guide 18 will at a point contact the lifting arm 26 of the lifting plate 22. As the media guide 18 moves further past this point, the lifting plate 22 is rotated in a clockwise direction (viewed from the bottom). This clockwise rotation causes the ramp 30 to come into contact with a corresponding stub 32 on an undersurface of the secondary pressure plate 14. Oppositely aligned sloping surfaces 34, 36 on the ramp 30 and stub 32 cooperate to lift the secondary pressure plate 14 to its in-use position. FIG. 5 shows a side elevation of the secondary pressure plate brought to the in-use position by the lifting plate 22.

Figure 6:
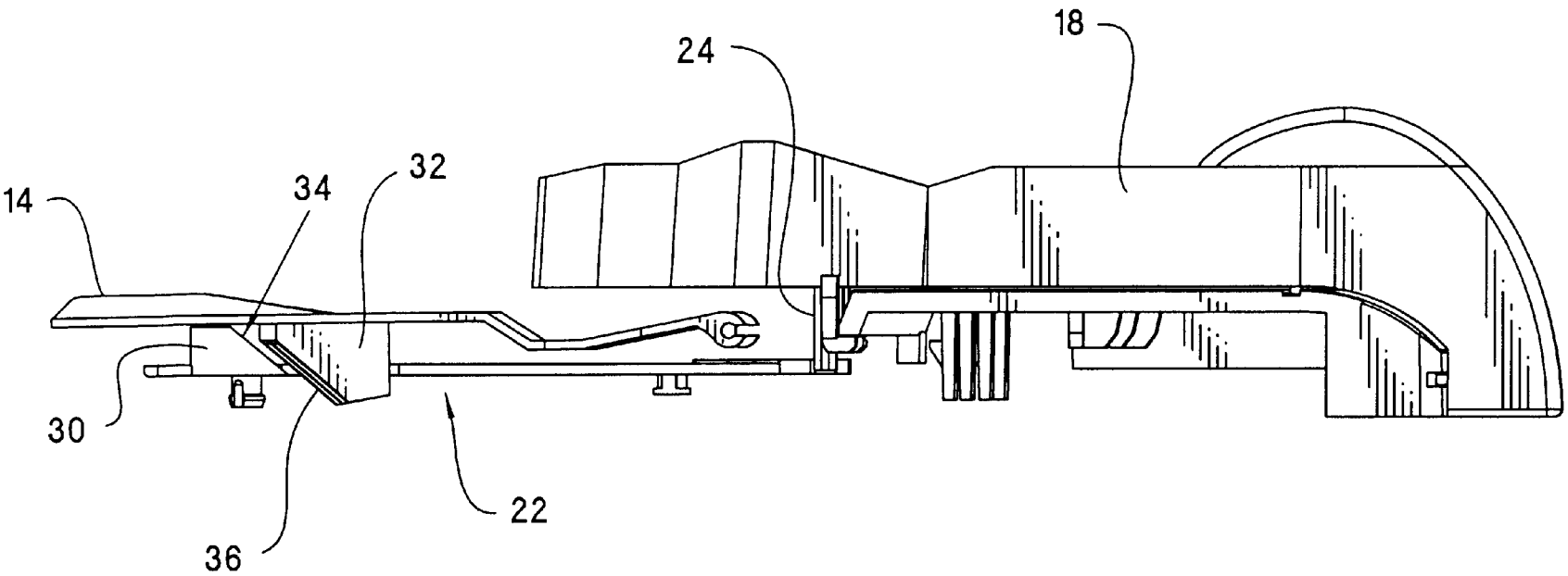
FIG. 6 is a side elevation of the media guide, lifting plate and secondary pressure plate as seen in a direction according to an arrow D in FIG. 3. The secondary pressure plate is shown in an unused position.

The secondary pressure plate 14 is lowered when the media guide 18 slides in the opposite direction to allow the main tray 4 to accommodate a stack of larger width sheet media. FIG. 6 shows the secondary pressure plate in an unused position. When moved in this opposite direction, the actuating pin 22 on the media guide 18 will contact the lowering arm 28 of the lifting plate 22. As the media guide 18 slides further in this opposite direction, the lifting plate 22 is rotated in an anti-clockwise direction (viewed from the bottom). Such an anti-clockwise rotation will cause the ramp 30 of the lifting plate 22 to move away from the stub 32 of the secondary pressure plate 14. The secondary pressure plate 14 under its weight will slide down the sloping surface 34 of the lifting ramp 30 as the lifting plate 26 is rotated. There will come a position where the ramp 30 is clear of the stub 32. At this position of the media guide 18, the secondary pressure plate 14 is lowered to rest on the primary pressure plate 10. In this position, the secondary pressure plate 14 is in an unused position where it moves up and down in accordance with the primary pressure plate 10.

The width of the secondary pressure plate is determined by the sizes of sheet media to be supported by the sheet media handling system. In this preferred embodiment, it is determined that the smaller width sheet media to be supported is of A4, Letter and other smaller sizes. It is common for printers to be used for printing on a range of sheet media widths, with A4 and Letter size sheet media being most common. As such, the secondary pressure plate is designed to be clear of where such sheet media would be placed on the printer. The secondary pressure plate 14 from this point substantially extends to where the maximum width of media would cover on the printer so as to provide the necessary support.

Figure 7:
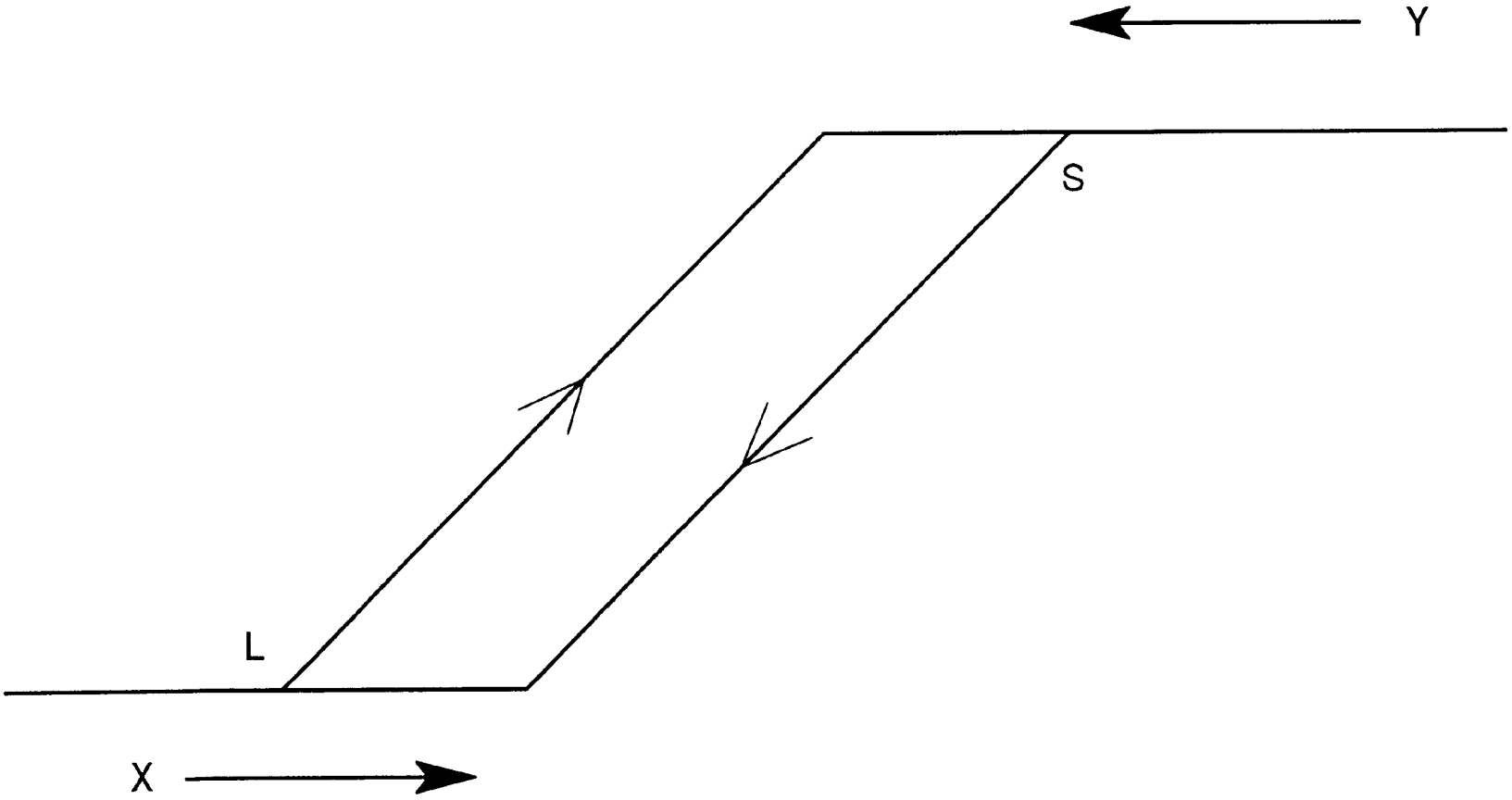

The positions along the path of the media guide where the secondary pressure plate should be completely raised and lowered to correspond with the in-use and unused positions are best illustrated with the aid of a hysterisis diagram. FIG. 7 shows such a hysterisis diagram for illustrating the movement profile of the secondary pressure plate 14 in response to media guide movement. Arrow X indicates the direction which the media guide is moved to align a stack of smaller width sheet media. Arrow Y indicates the opposite direction in which the media guide is moved to accommodate a stack of larger width sheet media. At a position corresponding to aligning a stack of Letter size sheet media (indicated by point S on the diagram), the secondary pressure plate 14 should preferably be completely raised to its in-use position. Further moving of the media guide in the same direction to align even smaller widths of sheet media should not disrupt the position of the secondary pressure plate. In the preferred embodiment, such a feature is achieved by allowing the actuating pin 24 to move clear of the lifting arm 26 of the lifting plate 22. In other words, point S corresponds to a position where the media guide 18 is aligned against a maximum width in the range of smaller width sheet media.

Similarly, as the media guide 18 moves in the opposite direction, the secondary pressure plate 14 should be completely lowered to its unused position when the media guide 18 is in a position corresponding to a minimum width of a range of larger width sheet media. This position is indicated at point L on the hysterisis diagram. It is not important at which positions the secondary pressure plate 14 begins to be raised or lowered by the lifting plate 22 so long as the lifting and lowering occur between the media guide positions corresponding to points S and L on the diagram. The design of the lifting plate 22 with the separate lifting and lowering arms 26, 28 provides such an actuation profile of the secondary pressure plate 14. It should be noted that the design of a lifting plate 22 is not limited to that described in the preferred embodiment. For example, a lifting plate with a single arm for lifting and lowering will work equally well. To provide for allowance for the moving of the media guide 18 to cater to different widths of sheet media without the further moving of the secondary pressure plate, it is only necessary for the ramp or the stub to be appropriately designed.

It should also not be construed that the invention is limited to that described in the preferred embodiment. Another equally applicable embodiment includes two separate non-overlapping pressure plates. Each of these two pressure plates are independently actuable by, for example, a similar cam used in the preferred embodiment for controlling the primary pressure plate. The width of the first pressure plate may be about the width of a Letter size sheet media. The width of the second pressure plate may be approximately the difference between a B4 size and a Letter size sheet media. When a stack of smaller width sheet media is placed over the first pressure plate and as the cams are rotated, the stack of sheet media will as previously described be raised to provide support for a larger width sheet media above it. Without any sheet medium to obstruct its movement, the second pressure plate will be able to extend fully to the infeed zone of a printer during a pick cycle to provide the necessary additional support for the larger width sheet medium. Such an alternative embodiment is also user friendly in that a user need not worry about the activation of the second pressure plate, because it will automatically be activated during each pick cycle.

Although the present invention is described using a sheet media handling system having a separate bypass tray, the secondary pressure plate can also be used in a system having only a single main tray which is able to accommodate sheet media of different widths.

We claim:

1. A sheet media handling system suitable for use in a printer comprising:

a main media tray for receiving first sheet media having an end portion;

a primary pressure plate pivotably mounted on the printer adjacent to the main media tray for supporting the end portion of the first sheet media and for moving the end portion of the first sheet media to a predetermined position for receiving into the printer;

a bypass media tray positioned above the main media tray for receiving second sheet media, an end portion of the second sheet media being supportable by the end portion of the first sheet media; and a secondary pressure plate adjacent to the primary pressure plate and moveable independently of the primary pressure plate to substantially the predetermined position for providing additional support to any unsupported end portion of the second sheet media.

2. The sheet media handling system according to claim 1, wherein the secondary pressure plate is pivotably mounted to the printer.

3. The sheet media handling system according to claim 2, further including a lifting plate transversely pivoted on the printer relative to the secondary pressure plate and operable for tilting the secondary pressure plate to the predetermined position.

4. The sheet media handling system according to claim 3, further including a media guide slidably mounted on the printer for aligning a stack of sheet media in the main tray and for actuating the lifting plate to rotate the lifting plate about its pivoting axis to operate the secondary pressure plate.

5. The sheet media handling system according to claim 4, wherein the lifting plate includes:

a lifting arm pivotably mounted to the printer; and a ramp connected to the lifting arm; and the secondary pressure plate includes a stub on an under surface of the secondary pressure plate;

wherein the lifting arm is rotatable such that the ramp bears upon the stub to cooperate with the stub to lift the secondary pressure plate.

6. The sheet media handling system according to claim 5, wherein the main tray is able to receive a first range of sizes of the first sheet media and wherein the lifting arm in engagement with the media guide tilts the secondary pressure plate to substantially the predetermined position when the media guide is moved to a position on the printer which corresponds to the maximum size in the first range.

7. The sheet media handling system according to claim 6, wherein the further moving of the media guide to positions on the printer corresponding to smaller sizes in the first range causes the media guide to disengage the lifting arm to leave the secondary pressure plate substantially at the predetermined position.

8. The sheet media handling system according to claim 7, wherein the lifting plate further includes:

a lowering arm which is operable when the media guide is moved away from the positions on the printer corresponding to the first range of sizes to lower the secondary pressure plate.

9. The sheet media handling system according to claim 8, wherein the secondary pressure plate is substantially lowered when the media guide is moved to a position on the printer which corresponds to a minimum size of a second range of sizes of sheet media.

10. The sheet media handling system according to claim 5, wherein the secondary pressure plate is moveable to sit in a correspondingly shaped indentation on the primary pressure plate and wherein the primary pressure plate has an aperture through which the stub of the secondary pressure plate protrudes for cooperating with the ramp on the lifting plate.

11. The sheet media handling system according to claim 1, wherein the secondary pressure plate is independently actuable and in a non-overlapping configuration with the primary pressure plate.

* * * * *